US012790761B2

(12) United States Patent
Rehrl et al.

(10) Patent No.: US 12,790,761 B2
(45) Date of Patent: Nov. 10, 2026

(54) FIBER PROCESSING DEVICE WITH AN ALIGNMENT UNIT FOR DISPLACING AND POSITIONING FIBERS AND METHOD FOR OPERATING A FIBER PROCESSING DEVICE

(71) Applicant: Kiefel GmbH, Freilassing (DE)

(72) Inventors: Josef Rehrl, Teisendorf (DE); Hubert Rehrl, Teisendorf (DE); Sebastian Limmer, Bischofswiesen (DE); Luis Olalla, Teisendorf (DE)

(73) Assignee: Kiefel GmbH, Freilassing (DE)

( * ) Notice: Subject to any disclaimer, the term of this patent is extended or adjusted under 35 U.S.C. 154(b) by 644 days.

(21) Appl. No.: 18/447,659

(22) Filed: Aug. 10, 2023

(65) Prior Publication Data

US 2024/0052578 A1 Feb. 15, 2024

(30) Foreign Application Priority Data

Aug. 12, 2022 (DE) ..... 10 2022 120 414.6

(51) Int. Cl.
*D21J 3/10* (2006.01)
*D21J 7/00* (2006.01)

(52) U.S. Cl.
CPC .. *D21J 3/10* (2013.01); *D21J 7/00* (2013.01)

(58) Field of Classification Search
CPC ..... D21J 3/10; D21J 7/00
USPC ..... 162/378, 218
See application file for complete search history.

(56) References Cited

U.S. PATENT DOCUMENTS 6,332,956 B1 * 12/2001 Lee ..... D21J 3/00 162/416
2017/0183869 A1 * 6/2017 Berger ..... B32B 7/03
2021/0247110 A1 * 8/2021 Miller ..... F25B 41/20
2022/0388201 A1 * 12/2022 Knoll ..... B29B 11/12

FOREIGN PATENT DOCUMENTS

CN 108357146 A 8/2018
CN 215943210 U 3/2022
KR 101109689 B1 2/2012

OTHER PUBLICATIONS

Extended European Search Report in Appl. No. 23188610.2 mailed Jan. 3, 2024, 3 pages.
Search Report in DE Appl. No. 10 2022 120 414.6 mailed May 9, 2023, 4 pages.

* cited by examiner

*Primary Examiner* — Jacob T Minskey
(74) *Attorney, Agent, or Firm* — Kowert, Hood, Munyon, Rankin & Goetzel, P.C.; Gareth M. Sampson; Dean M. Munyon

(57) ABSTRACT

A fiber processing device and a method for operating a fiber processing device are described, wherein the fiber processing device has at least one forming station with an exchangeable tool and an alignment unit which has a plurality of outlet openings for a medium, wherein a medium for displacing and positioning fibers on the surface of a tool is dispensed via the outlet openings in determinable time periods, wherein different tools can be received in the forming station in order to produce different three-dimensional molded parts, wherein a tool received in the forming station is exchanged for another tool, and the outlet openings of at least one alignment unit are changed in accordance with the received tool and its configuration.

20 Claims, 7 Drawing Sheets

FIBER PROCESSING DEVICE WITH AN ALIGNMENT UNIT FOR DISPLACING AND POSITIONING FIBERS AND METHOD FOR OPERATING A FIBER PROCESSING DEVICE

CROSS-REFERENCE TO RELATED APPLICATIONS

The present application claims priority under 35 U.S.C. § 119 to German Patent Application No. DE 10 2022 120 414.6, filed Aug. 12, 2022, the disclosure of which is incorporated by reference herein in its entirety.

TECHNICAL FIELD

A fiber processing device for producing three-dimensional molded parts from a fiber-containing material, having an interchangeable tool and an alignment unit for displacing and positioning fibers, and a method for operating a fiber processing device for producing three-dimensional molded parts from a fiber-containing material, having an interchangeable tool and an alignment unit, are described.

DESCRIPTION OF RELATED ART

Fiber-containing materials are increasingly used, for example, to produce packaging for food (e.g., trays, capsules, boxes, etc.) and consumer goods (e.g., electronic devices, etc.) as well as beverage containers. Everyday items, such as disposable cutlery and tableware, are also made from fiber-containing material. Fiber-containing materials contain natural fibers or artificial fibers. Recently, fiber-containing material is increasingly used that has or is made of natural fibers which can be obtained, for example, from renewable raw materials or waste paper. The natural fibers are mixed in a so-called pulp with water and optionally further additives, such as starch. Additives can also have an effect on color, barrier properties and mechanical properties. This pulp can have a proportion of natural fibers of, for example, 0.5 to 10% by weight. The proportion of natural fibers varies depending on the method used for the production of packaging etc. and the product properties of the product to be produced.

The production of fiber-containing products from a pulp generally takes place in several work steps. For this purpose, a fiber processing device has multiple stations or forming stations. In a forming station, for example, fibers can be suctioned in a cavity of an intake tool, thus forming a preform. For this purpose, the pulp is provided in a pulp supply, and the suction tool is at least partially immersed in the pulp with at least one suction cavity whose geometry essentially corresponds to the product to be manufactured. During the immersion, suction takes place via openings in the suction cavity, which are connected to a corresponding suction device, wherein fibers from the pulp accumulate on the surface of the suction cavity. The suctioned fibers or a preform can subsequently be brought into a pre-pressing tool via the suction tool, and the preform is pre-pressed. During this pre-pressing process, the fibers in the preform are compressed and the water content of the preform is reduced. Alternatively, preforms can be provided by means of scooping, wherein a scoop tool is immersed in the pulp and during startup fibers are deposited on molded parts of the scoop tool.

After this, preforms are pressed in a hot press to form finished molded parts. In this process, preforms are inserted into a hot press tool which has, for example, a lower tool half and an upper tool half which are heated. In the hot press tool, the preforms are pressed in a cavity under heat input, with residual moisture being removed by the pressure and heat so that the moisture content of the preforms is reduced from about 60% by weight before hot pressing to, for example, 5-10% by weight after hot pressing. The steam produced during hot pressing is suctioned off during the hot pressing via openings in the cavities and channels in the hot press tool.

A hot press tool and a manufacturing method using the hot pressing process described above are known, for example, from DE 10 2019 127 562 A1.

In addition, before the pre-pressing, fibers which are deposited on the suction tool outside the shaping surfaces in the suction cavities can be rinsed away by water via a spray bar. The spray bar includes a plurality of nozzles which are arranged at regular intervals. After the suction of pulp via the suction tool, this tool is moved in the direction of the spray bar. Then water is output via the nozzles, which impinges on the surface of the suction tool. By displacing the spray bar, the entire surface is sprayed, wherein fibers located on the surface of the suction tool outside the suction cavities are rinsed away. The fibers located in the suction cavities are not displaced by the impinging water because the fibers continue to be suctioned in. In this process, the impinging water is also suctioned in through the fiber layers so that there is essentially no increase in the water content of preforms.

Problems arise in the above-described fiber forming devices in particular in that fibers which project past shaping surfaces of suction cavities cannot be displaced for a large number of different molded part geometries in the edge region for optimal edge formation via the water jet. Therefore, preforms with inaccurately formed edges must be further processed so that an additional processing of the edge is required at the end.

Currently, a defined formation of the edge is achieved by subsequent stamping. Thus, the effort for producing three-dimensional molded parts is very complicated and requires a large number of processing steps. Waste is produced during the stamping, which cannot be returned to the pulp. Thus, the waste produced during the stamping process is present as a hot-pressed ring, which must first be pretreated before it can be reintroduced into the pulp.

SUMMARY OF DISCLOSED EMBODIMENTS

Problem

In contrast, it is desirable to further improve the production of three-dimensional molded parts so that fewer processing steps are required, the molded parts already essentially have their final shape or edge formation, less or no waste is produced, and the required resources (energy, material, etc.) are kept low. Furthermore, it is desirable to provide an alternative to the prior art and to ensure improved production for a large number of different mold part geometries.

Solution

The above-named problems are solved by a fiber processing device for producing three-dimensional molded parts from a fiber-containing material, at least including a forming station with an exchangeable tool in which fiber-containing material can be processed, wherein different tools for producing different three-dimensional molded parts can be accommodated in the at least one forming station, and at least one alignment unit assigned to at least one tool for displacing and supporting the positioning of fibers which are located on a surface of a tool, wherein the at least one alignment unit has a plurality of outlet openings for a medium, wherein the at least one alignment unit can be supplied with a medium which can be dispensed via the outlet openings for displacing and supporting the positioning of fibers on the surface of a tool, and wherein the outlet openings of the at least one alignment unit can be changed and/or adapted as determined by a tool accommodated in the forming station.

The alignment unit has outlet openings which are designed and aligned corresponding to the accommodated tool. It is thus achieved that all fibers on the surface of a tool are displaced in a targeted manner into the regions which, for example, are provided for forming preforms and for example are designed accordingly for this purpose. Such shaping surfaces or forming surfaces can have, for example, suction openings which both hold the fibers on the forming surfaces and suction water out of the arrangement of fibers.

It is thus advantageously achieved that all fibers are brought to the forming surfaces on the surface of a tool. Fibers in the edge region of the forming surfaces, which project beyond the forming surfaces and would produce an imprecise, fibrous edge, are additionally brought into the region of the forming surfaces, in particular sprayed, by the medium which is discharged in a directed manner via the outlet openings, so that a defined clear edge design can be achieved in preforms.

For the displacement and positioning of the fibers on the surface of a tool, which may be, for example, a suction tool with at least one suction cavity for the formation of preforms which are subsequently processed into three-dimensional molded parts in further processing steps, the outlet openings have a corresponding design and arrangement so that the medium can bring fibers into the desired areas accordingly.

If a tool change is carried out, the outlet openings are changed in their orientation for outputting the medium and/or the outlet openings are adapted. An adaptation can include, for example, the exchange or change of an alignment unit or a part of the alignment unit.

Compared with known devices, it is thus possible to ensure that all the fibers on the surface of a tool rest on the forming surfaces, and to achieve an improved formation of edges.

The medium used may be for example a gas or gas mixture (e.g., air) or a liquid (e.g., water). In further embodiments, an additive may be admixed with a water.

Suction cavities in a tool have openings for suctioning the fibers. Here, there is often contamination in the area of the openings, which must be removed to ensure that suction can be provided in the same manner over the entire surface. The surfaces of suction cavities frequently have a net-like structure which can be contaminated particularly easily.

The alignment unit can therefore dispense a medium onto the surface of the tool, and in particular the surfaces of the cavities, at regular intervals in order to clean the suction cavities. When a cleaning takes place, no fibers are suctioned in beforehand, so that the cavities are free. The medium is then only dispensed onto the surface of the cavities. Here a particular orientation of an impinging stream of medium can be selected which loosens fibers and contaminants. For example, during such a cleaning process, a gas or gas mixture (e.g., air) can additionally be blown out of the suction openings in the suction cavities to support the loosening of the fibers/contaminants.

The intervals between such cleaning can depend on which pulp, or pulp compositions, is processed, which geometries have the molded parts or preforms to be manufactured and/or which fiber type and length is used.

In further embodiments, at least one parameter of at least one outlet opening of the at least one alignment unit is changeable for changing the quantity, direction, type and/or orientation of the dispensable medium. The medium can be output via an outlet opening, for example in a fan-like manner, in a straight line, and/or in a different quantity, orientation and at different pressure. By changing at least one parameter, the above medium properties are changed.

For this purpose, in further embodiments, the at least one parameter can define the diameter, the shape, the orientation and/or the size of the at least one outlet opening. A change in the diameter, the orientation and/or the size of the at least one outlet opening changes the quantity, the direction, the type and/or the orientation of the output medium. Furthermore, the at least one parameter can relate, for example, to the pressure with which a medium is output via the outlet openings or a medium is fed to the alignment unit.

In further embodiments, the at least one alignment unit can be exchangeable for an adjustment during a tool change so that a defined displacement and positioning of fibers on the surface of a tool can always take place.

In further embodiments, the outlet openings can be adaptable in accordance with the tool received in the forming station, wherein the outlet openings can additionally or alternatively be changeable to change the alignment unit. For example, a specific alignment unit can cover different tool types or shapes which do not differ or differ only slightly with regard to the size of, for example, cavities, and/or number of cavities so that a displacement and positioning of fibers can be achieved by changing the orientation of outlet openings. For other tool types or shapes, on the other hand, it may be necessary to exchange the alignment unit.

In further embodiments, the adaptation of the outlet openings can take place and/or be executable automatically during a tool change. For this purpose, a tool can, for example, have a coding or another feature which makes a unique identification possible. After the recognition of this tool, via a control unit of the fiber processing device, controlling can take place to change the alignment, the cross-section, etc. of the outlet openings. Furthermore, it is possible that, for example, an orifice plate of the alignment unit is mechanically displaced when a tool change takes place because, for example, the tool has a differently designed interface element that displaces the orifice plate to change the cross-section and/or alignment of outlet openings.

In further embodiments, a tool and an associated alignment unit for this tool can have a feature for an unambiguous assignment, wherein operation thereof is only possible when the associated units (tool and alignment unit) are accommodated in the fiber processing device.

In further embodiments, the outlet openings can be variable pneumatically, hydraulically, electrically, mechanically and/or electromechanically. In this case, a controlling or modification of the outlet openings (diameter, orientation, shape, etc.) can be done via different means and systems. A remote controlling (NFC, WLAN, LAN, etc.) is thus also possible. In this case, for example, an adjustment can take place mechanically, as explained above, via corresponding interface elements. In alternative embodiments, servomotors can also be provided which control each outlet opening independently of other outlet openings.

In further embodiments, the outlet openings can always be aligned and/or adaptable in accordance with the position of mold bodies and/or cavities of a tool received in the forming station and/or the geometry of the mold bodies and/or cavities of a tool received in the forming station.

In further embodiments, the outlet openings of an alignment unit can be individually controllable and/or outlet openings of an alignment unit can be combined into groups that are controllable together, wherein the outlet openings and/or groups of outlet openings of an alignment unit can be controlled independently of other outlet openings or groups of outlet openings of the alignment unit with respect to direction, quantity and duration of the dispensed medium. A larger number of tool types can thus be covered by means of an alignment unit. In particular in tools having differently formed cavities, a portion of the outlet openings can for example be unchanged, or changed less strongly, when there is an exchange.

In further embodiments, the outlet openings can be designed as nozzles. Media can be output in a very targeted manner via nozzles. In addition, nozzles offer the possibility of changing the quantity, orientation and type of output (e.g., changing the type of jet).

In further embodiments, a number of outlet openings or nozzles are combined to form a group which is assigned to a cavity. Thus, a cavity-dependent controlling can always take place. In such an embodiment, a change can be made, for example, between a first position and a second position of the outlet openings or nozzles, wherein a first position for the positioning of fibers and a second position for the cleaning are formed. This is advantageous, for example, for embodiments with a large number of rows and columns of nozzles which do not have to be displaced but is situated opposite a lower side of a suction tool with cavities.

The above-mentioned problem solution is also achieved by a method for operating a fiber processing device for producing three-dimensional molded parts from a fiber-containing material, at least including a forming station with an exchangeable tool and an alignment unit, having a plurality of outlet openings for a medium, wherein a medium for displacing and assisting the positioning of fibers on the surface of a tool is dispensed via the outlet openings in determinable time periods, wherein different tools can be received in the forming station in order to produce different three-dimensional molded parts, and wherein, in the case of an exchange of a tool received in the forming station for another tool, the outlet openings of at least one alignment unit are changed in accordance with the received tool and its configuration.

The method makes it possible to adapt the outlet openings to different tools, which for example have differently formed cavities. It is thus achieved that preforms and three-dimensional molded parts can be produced which have a clear edge formation which does not require any post-processing. In addition, the method ensures that all fibers which are located on the surface of a tool can be brought into the cavities. The outlet openings are always aligned and/or adapted in accordance with a tool received in the forming station.

With regard to the advantages, reference is made to the statements regarding the fiber processing device, which apply here as well.

In further embodiments, at least one parameter of at least one outlet opening can be changed to change the quantity, direction, type, and/or orientation of the dispensed medium, wherein the at least one parameter defines the diameter, shape, orientation, and/or size of the at least one outlet opening. Changes in the diameter, the shape, in particular the cross-sectional shape (for example square to rectangular and vice versa), the orientation and/or the size can be carried out easily and additionally offer an individual adaptation to different tool surfaces, tool formations and designs/arrangements of cavities.

In further embodiments, an alignment unit can be exchanged for another alignment unit when a tool is exchanged in the forming station for another tool, wherein a defined alignment unit is assigned to each tool. Thus, for each tool there is an alignment unit designed and aligned exactly for it.

In further embodiments, the outlet openings can be automatically adapted and/or changed during a tool change. This can take place, for example, via a corresponding code. This ensures that the outlet openings always have the required orientation.

In further embodiments, the outlet openings can be changed pneumatically, hydraulically, electrically, mechanically and/or electromechanically. Such a change includes both, direct change, for example electrical controlling of outlet openings or nozzles via servomotors, and indirect change, for example by an electrical, pneumatic, hydraulic, electromechanical actuation/displacement of an orifice plate, wherein the orifice plate mechanically changes the opening width and the opening shape of outlet openings through the displacement.

In further embodiments, the outlet openings can be aligned and/or adapted according to the position of mold bodies and/or cavities of a tool received in the forming station and/or the geometry of the mold bodies and/or cavities of a tool received in the forming station.

In further embodiments, the outlet openings can be closed in order to prevent the dispensing of medium. In such embodiments, it is possible, via controlling of the outlet openings, not only to change the direction, the quantity and the shape of an output medium, but also to completely prevent the dispensing of medium. In this way, all functions can be mapped via a control device.

In further embodiments, outlet openings of an alignment unit or groups of outlet openings of an alignment unit can be controlled independently of other outlet openings or groups of outlet openings of the alignment unit with respect to the direction, quantity and duration of discharged medium. A partial adaptation can thus take place which, for example, relates only to a part of the surface of a tool or a part of the cavities of a tool.

In further embodiments, individual outlet openings and/or groups of outlet openings of a tool can also be closed, wherein other outlet openings and/or groups of outlet openings of this tool remain open or are adapted. Thus, during the processing of fibers or during operation of a fiber processing device states can occur in which outlet openings of an alignment unit are opened and other outlet openings of this alignment unit are closed. This expands the individual regulation of the output of medium. For example, in tools with relatively large distances between cavities, some of the outlet openings can thus be closed. In the case of such tools, there are generally no fibers in the region between cavities because suctioning takes place only in the region of the cavities. Isolated fibers which deposit in the region between the cavities can, for example, be displaced via individual outlet openings to the cavities via the medium. However, it is not necessary to discharge a medium through all outlet openings. This provides a resource-saving use of the medium. In addition to the saving of dispensed medium, less medium also impinges on the surface of a tool, which medium has to be removed. The control effort and the effort for operating a fiber processing device can thus be further reduced.

In further embodiments, an alignment unit can be designed as a bar which has a plurality of outlet openings. The outlet openings can extend along the bar at regular intervals. For positioning and displacing fibers, the bar is moved over the surface of a tool. Here, it may be necessary for the outlet openings to be continuously changed and adapted while the tool surface is traveled over, in order to achieve a defined positioning of fibers on the surface and in particular an orientation and positioning of fibers in edge regions of a preform and a cavity. In addition to the change and adaptation of outlet openings, continuous opening and closing of outlet openings can take place during the passage over the tool surface.

In further embodiments, the bar can be displaced or moved in order, for example, to change the angle at which the medium impinges on a surface. For this purpose, the bar can additionally be rotated or tilted during a continuous displacement. This can take place in particular during a movement of the bar or of an alignment unit so that an additional change is achieved which affects the dispensing of media.

In further embodiments, an alignment unit can have, for example, a plurality of outlet openings which are arranged at least in two or more rows. In still further embodiments, an alignment unit can also have a plurality of outlet openings which cover the entire surface of a tool, so that no travel over the surface is required. In yet further embodiments, only the outlet openings can be actively operated which are assigned to an edge region of a cavity, in order to correspondingly position the fibers in the edge region and to support the formation of the edge region. The other non-required outlet openings can be closed so that no medium escapes through them.

In still further embodiments, a fiber processing device can have a pump or another conveying device for providing a medium which is operated in accordance with the required quantity of medium, wherein the required quantity of medium is measured according to how many outlet openings are open and the output rate they have.

In further embodiments, alignment units can also be provided for this purpose in forming stations other than in a described suction tool. For example, here it can be brought about that protruding fibers of preforms are displaced in a press, before a hot pressing and closing of the hot press tools, for the defined formation of edges via a medium.

In further embodiments, at least two different states can be set for the outlet openings or nozzles of an alignment unit. In a first state, the outlet openings are controlled such that fibers are brought into the edge region of cavities via a medium. For this purpose, for example, all nozzles or outlet openings can provide an output of medium. However, this is not mandatory. In a second state, for cleaning the suction cavities, a medium is discharged only through the nozzles or outlets directed toward the suction cavities. In addition, in the second state a change in the orientation of nozzles or outlet openings can be set so that, for example, a jet of medium is discharged which can loosen impurities and adhesions on the surface of the suction cavity due to a higher pressure compared to a pure displacement in the first state, for example by a fan-shaped jet. In the second state, the nozzles or outlet openings can have a different orientation. In particular, nozzles can be controlled very easily for different orientations, jet types and output quantities by relative movement of two nozzle elements in only one direction of movement.

Further features, embodiments and advantages result from the following illustration of exemplary embodiments with reference to the figures.

DETAILED DESCRIPTION

Exemplary embodiments of the technical teaching described herein are shown below with reference to the figures. Identical reference signs are used in the figure description for identical components, parts and processes. Components, parts and processes which are not essential to the technical teachings disclosed herein or which are obvious to a person skilled in the art are not explicitly reproduced. Features specified in the singular also include the plural unless explicitly stated otherwise. This applies in particular to statements such as "a" or "one."

Figure 1:
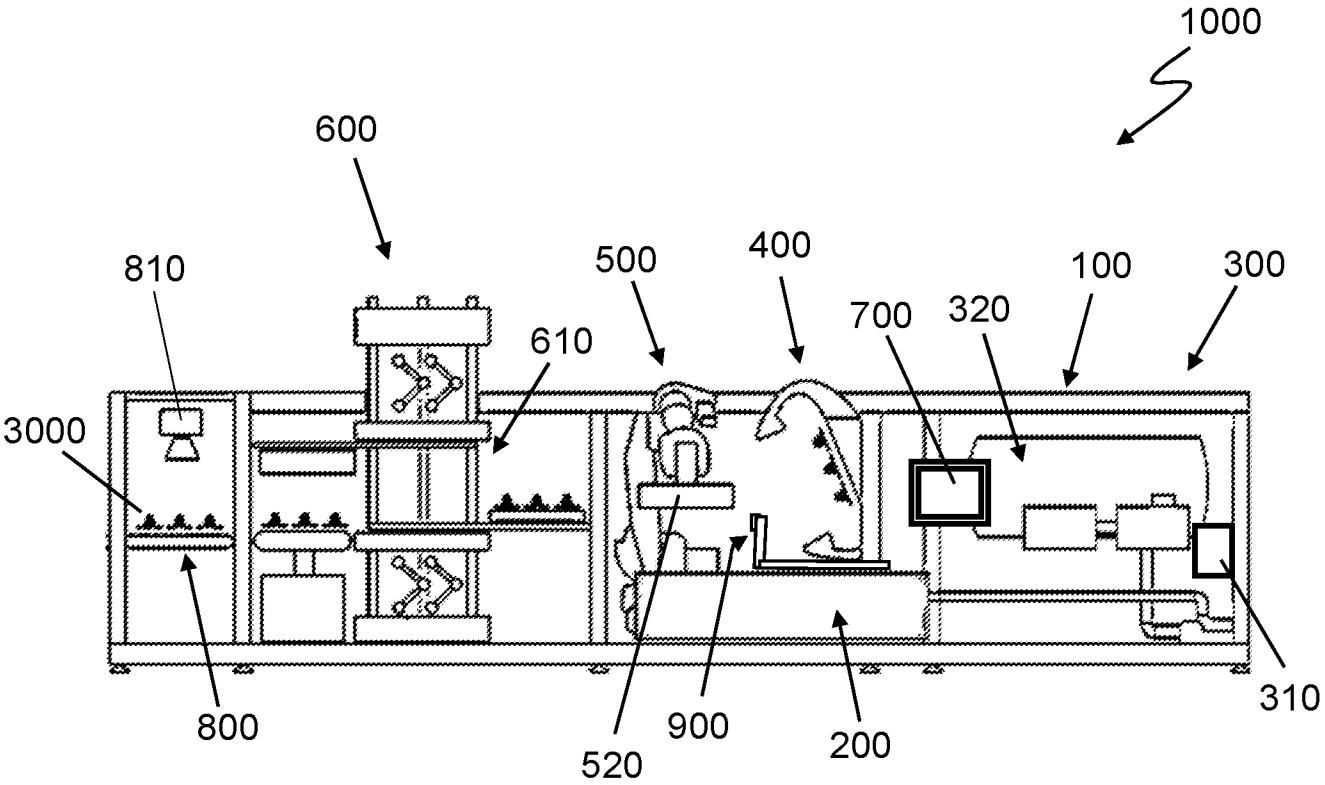
FIG. 1 shows a schematic representation of a fiber processing device for producing three-dimensional molded parts from a fiber-containing material.

FIG. 1 shows a schematic representation of a fiber processing device 1000 for producing three-dimensional molded parts from a fiber-containing material. In the exemplary embodiment shown, the fiber-containing material for the production of molded parts is provided by a fiber preparation plant and is made available to the fiber processing device 1000. The provision and the making available can for example take place via supply lines, in which liquid pulp is fed from a fiber preparation plant to a storage container or pulp tank 200 of the fiber processing device 1000, for example continuously or discontinuously. Alternatively, pulp can be prepared in a pulp tank 200 of the fiber processing device 1000. For this purpose, water and fibrous materials as well as additives, if any, can be introduced into a pulp tank 200 via a liquid supply, and the pulp can be prepared in the pulp tank 200 by mixing the individual components with heat input and by auxiliary means, such as an agitator.

Pulp refers to an aqueous solution containing fibers, wherein the fiber content of the aqueous solution can be in a range of 0.5 to 10% by weight. In addition, additives such as starch, chemical additives, wax, etc. can be present. The fibers can be, for example, natural fibers, such as cellulose fibers, or fibers from a fiber-containing original material (for example waste paper). A fiber treatment plant offers the possibility of preparing pulp in a large quantity and providing several fiber processing devices 1000.

The fiber processing device 1000 can be used to produce, for example, biodegradable cups 3000 (FIG. 11), capsules, trays, plates, and other molded and/or packaged parts (e.g., as holder/support structures for electronic devices). Since a fibrous pulp with natural fibers is used as the starting material for the products, the products manufactured in this way can themselves be used as a starting material for the manufacture of such products after their use, or they can be composted, because they can usually be completely decomposed and do not contain any substances that are harmful to the environment.

The fiber processing device 1000 shown in FIG. 1 has a frame 100 which can be surrounded by a cladding. The supply units 300 of the fiber processing device 1000 include, for example, interfaces for the supply of media (for example water, pulp, compressed air, gas, etc.) and energy (power supply), a central control unit 310, at least one suction device 320, line systems for the various media, pumps, valves, lines, sensors, measuring devices, a bus system, etc., and interfaces for bidirectional communication via a wired and/or wireless data connection. Instead of a wired data connection, there can also be a data connection via a fiber optic line. The data connection can be, for example, between the control unit 310 and a central controller for multiple fiber processing devices 1000, to a fiber preparation plant, to a service point, and/or further devices. It is also possible to control the fiber processing device 1000 via a bidirectional data connection via a mobile device, such as a smartphone, tablet computer, or the like.

The control unit 310 is in bidirectional communication with an HMI panel 700 via a bus system or a data connection. The HMI (Human Machine Interface) panel 700 has a display which displays operating data and states of the fiber processing device 1000 for selectable components or the entire fiber processing device 1000. The display can be designed as a touch display so that adjustments can be made manually by an operator of the fiber processing device 1000. Additionally or alternatively, further input means, such as a keyboard, a joystick, a keypad, etc. for operator inputs, can be provided on the HMI panel 700. In this way, settings can be changed and the operation of the fiber processing device 1000 can be influenced.

The fiber processing device 1000 has a robot 500. The robot 500 is designed as a so-called 6-axis robot and is thus able to pick up parts within its radius of action, to rotate them and to move them in all spatial directions. Instead of the robot 500 shown in the figures, other handling devices can also be provided that are designed to pick up and twist or rotate products and move them in the various spatial directions. In addition, such a handling device may also be otherwise configured, in which case the arrangement of the corresponding stations of the fiber processing device 1000 may differ from the embodiment shown.

A suction tool 520 is arranged on the robot 500. In the embodiment shown, the suction tool 520 has cavities 522 formed as negatives of the molded parts to be formed, such as by cups 3000 shown in FIG. 11, for example, as suction cavities. The cavities 522 can have, for example, a net-like surface on which fibers from the pulp are deposited during the suction. Behind the net-like surfaces, the cavities 522 are connected to a suction device via channels in the suction tool 520. The suction device can be realized, for example, by an suction device 320. Pulp can be suctioned in via the suction device when the suction tool 520 is located within the pulp tank 200 in such a way that the cavities 522 are at least partially located in the aqueous fiber solution, the pulp. A vacuum, or a negative pressure, for suctioning fibers when the suction tool 520 is located in the pulp tank 200 and the pulp, can be provided via the suction device 320. For this purpose, the fiber processing device 1000 has corresponding means at the supply units 300. The suction tool 520 has lines for providing the vacuum/negative pressure from the suction device 320 in the supply units 300 to the suction tool 520 and the openings in the cavities 522. Valves are arranged in the lines, which can be controlled via the control unit 310 and thus regulate the suction of the fibers. It is also possible for the suction device 320 to perform a "blow-out" instead of a suction, for which purpose the suction device 320 is switched to another operating mode in accordance with its design.

In the production of molded parts made of a fiber material, the suction tool 520 is immersed in the pulp and a negative pressure/vacuum is applied to the openings of the cavities 522 so that fibers are suctioned out of the pulp and are deposited for example on the network of the cavities 522 of the suction tool 520.

Figure 2:
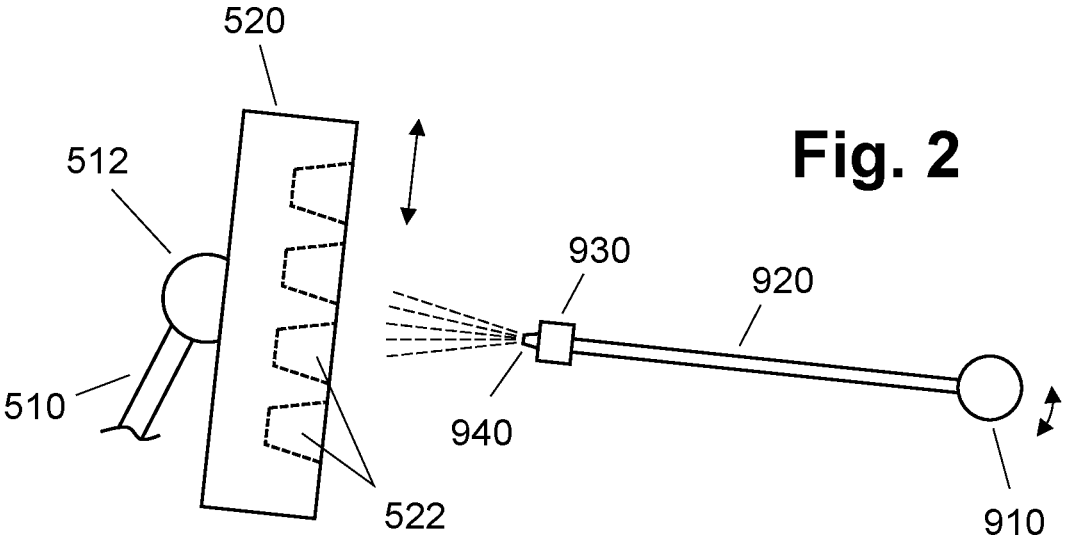
FIG. 2 shows a schematic representation of an alignment unit and a suction tool.

The robot 500 then lifts the suction tool 520 out of the pulp tank 200 and moves it in the direction of an alignment unit 900. The alignment unit 900 has a bar 930 with a plurality of nozzles 940 (see, for example, FIGS. 2-7). The bar 930 is mounted on a movable arm 920. Via the arm 920, the bar 930 can be moved along a circular path, for example by means of a drive, as shown in FIG. 2, or moved parallel to the lower surface of the suction tool 520 with the cavities 522, shown in FIG. 1. In the embodiment shown, for example water is dispensed as a medium via the nozzles 940.

In the production of molded parts before pre-pressing, the medium brings about positioning or displacement of fibers in the edge region of the cavities 522 so that preforms formed by the fibers in the cavities 522 have a finer edge formation. In addition to the edge formation, a cleaning of the cavities 522 can be carried out via the medium at regular intervals or in accordance with the degree of contamination of the cavities 522.

For example, so that water can be brought via the nozzles 940 onto the underside of the suction tool 520 or the surface of the suction tool 520 with the cavities 522, the suction tool 520 is lifted out of the pulp tank 200 via the robot 500 and, with regard to FIG. 1, is swiveled to the right so that the cavities 522 point in the direction of the pre-press station 400. Before or after positioning the suction tool 520, the bar 930 is moved into position so that travel from top to bottom can occur. Dispensing of media is not started until the bar 930 is in the upper position and the cavities 522 are aligned with the pre-press station 400 and the alignment unit 900. Subsequently, the edge formation is started with the aid of the water, wherein water is dispensed via all nozzles 940, for example. The nozzles 940 can be aligned such that a defined orientation is present for the cavities 522 and molded parts. The bar 930 is subsequently moved from top to bottom with simultaneous dispensing of water parallel to the underside of the suction tool 520. After the bar 930 has traveled the entire lower surface of the suction tool 520 with the cavities 522 and has arrived at the lower position, the suction tool 520 is moved further to the pre-pressing station 400. The bar 930 remains in the lower position until at least the robot 500 no longer moves into the path of the alignment unit 900. The bar 930 can, for example, be brought into the upper position only after fibers have been suctioned out of the pulp.

The robot 500 moves the suction tool 520 with the fibers adhering to the cavities 522, which still have a relatively high moisture content of, for example, over 80% by weight of water, to the pre-pressing station 400 of the fiber processing device 1000, wherein the negative pressure is maintained in the cavities 522 for the transfer. The pre-pressing station 400 has a pre-pressing tool with pre-pressing molds. The pre-pressing molds can be formed, for example, as positive of the molded parts to be manufactured and have a corresponding size with regard to the shape of the molded parts for receiving the fibers adhering in the cavities 522.

In the production of molded parts, the suction tool 520 is moved, with the fibers adhering in the cavities, to the pre-pressing station 400 in such a way that the fibers are pressed into the cavities 522. The fibers are pressed together in the cavities, so that a stronger connection is thereby produced between the fibers. In addition, the moisture content of the preforms formed from the suctioned-in fibers is reduced, so that the preforms formed after the pre-pressing only have a moisture content of, for example, 60% by weight.

During the pre-pressing, liquid or pulp can be extracted and returned via the suction tool 520 and/or via further openings in the pre-pressing molds. The liquid or pulp discharged during suction via the suction tool 520 and/or during pre-pressing in the pre-press station 400 can be returned to the pulp tank 200.

After pre-pressing in the pre-pressing station 400, the preforms produced in this way are moved to a hot pressing station 600 on the suction tool 520 via the robot 500. For this purpose, the negative pressure is maintained at the suction tool 520 so that the preforms remain in the cavities 522. The preforms are transferred via the suction tool 520 to a lower tool body which can be moved along the production line out of the hot pressing device 610. If the lower tool body is in its extended position, the suction tool 520 is moved to the lower tool body in such a way that the preforms can be placed on forming devices of the lower tool body. Subsequently, an overpressure is produced via the openings in the suction tool 520 so that the preforms are actively deposited by the cavities 522, or the suction is ended, so that the preforms remain on the forming devices of the lower tool body due to gravity. By providing overpressure at the openings of the cavities 522, pre-pressed preforms which rest/adhere in the cavities 522 can be released and dispensed.

Thereafter, the suction tool 520 is moved away via the robot 500 and the suction tool 520 is dipped into the pulp tank 200 in order to suction further fibers for the production of molded parts from fiber-containing material.

After the transfer of the preforms, the lower tool body moves into the hot pressing station 600. In the hot pressing station 600, the preforms are pressed into finished molded parts under heat and high pressure, for which purpose an upper tool body is brought onto the lower tool body via a press. The upper tool body has cavities corresponding to the forming devices. After the hot pressing operation, the lower tool body and the upper tool body are moved away relatively from one another and the upper tool body is moved along the fiber processing device 1000 in the manufacturing direction, wherein after the hot pressing the manufactured molded parts are suctioned in via the upper tool body and thus remain within the cavities. Thus, the manufactured molded parts are brought out of the hot pressing station 600 and deposited via the upper tool body after the method on a transport belt of a conveyor device 800. After the deposition, the suction via the upper tool body is ended and the molded parts remain on the transport belt. The upper tool body moves back into the hot pressing station 600 and a further hot pressing operation can be carried out.

The fiber processing device 1000 further has a conveying device 800 with a transport belt. The manufactured molded parts made of fiber-containing material can be placed on the transport belt after the final molding and the hot pressing in the hot pressing station 600 and discharged from the fiber processing device 1000. In further embodiments, after placing the molded parts on the transport belt of the conveying device 800, further processing can take place, such as filling and/or stacking the products. The stacking can take place, for example, via an additional robot or another device.

In further embodiments, a fiber processing device 1000 can have a crane for changing a lower tool body and an upper tool body, a suction tool 520, a pre-pressing tool, and a bar 930 or further components of the alignment unit 900 for retooling the fiber processing device 1000 to other molded parts or for maintenance of the tools or alignment units 900.

The fiber processing device 1000 from FIG. 1 shows a possible embodiment. A fiber processing device according to the technical teaching described herein can also have only one forming station with a replaceable tool, for example a suction tool 520, in which fiber-containing material can be processed, wherein different tools for producing different three-dimensional molded parts can be received in the at least one forming station, and at least one alignment unit 900 assigned to at least one tool for displacing and positioning fibers. The further stations and devices shown for the fiber processing device 1000 of FIG. 1 are not absolutely necessary for implementing the technical teaching.

FIG. 2 shows a schematic view of an alignment unit 900 and a suction tool 520. The position of a suction tool 520 after the suction of pulp is shown when a positioning or displacement of fibers in the edge region of the cavities 522 of the suction tool 520 is to take place via a liquid medium, for example water. For this purpose, the suction tool 520 has been pivoted and moved via the robot 500 such that the underside of the suction tool 520 with the cavities 522 is aligned with the alignment unit 900. In addition, the suction tool 520 is inclined as in FIG. 2 such that water can flow slightly downwards on the surface of the suction tool 520 due to gravity.

The suction tool 520 is connected to a robot interface 512 which is designed to receive different suction tools 520. The robot interface 512 has connecting elements for a mechanical connection to corresponding connecting elements of the suction tool 520 and lines for suctioning water and pulp. The robot interface 512 is connected to a robot arm 510 of robot 500.

The alignment unit 900 of FIG. 2 can be rotated by an arm 920 in the bearing 910 in the direction of the arrow so that the bar 930 with the nozzles 940 can be moved from top to bottom in the direction of the arrow. In further embodiments, traveling over the underside of the suction tool 520 with the cavities 522 may also take place in both directions, as indicated in FIG. 2. In further embodiments, as described for the alignment unit 900 of FIG. 1, a parallel travel of the underside of the suction tool 520 from top to bottom takes place, ensuring a constant distance between the nozzles 940 and the cavities 522 and the underside of the suction tool 520. This embodiment is thus preferable, because the displacement can be controlled more precisely.

As shown schematically in FIG. 2, via the nozzles 940 a medium is output, which impinges on the cavities 522 and thus leads to a displacement of the fibers in the edge region of the cavities 522, so that the fibers are only located on the shaping surfaces of the cavities 522.

In addition to the displacement of the fibers, a cleaning of the shaping surfaces of the cavities 522 can also take place via the alignment unit 900. These surfaces are frequently designed in the manner of a net. An adhering of fibers may occur in this context. To ensure that the adhering fibers do not impair the manufacturing process and, in particular, the suctioning of fibers, so that a uniform suctioning of fibers can take place over the entire surface of the shaping surfaces of the cavities, a cleaning is carried out at regular intervals, for example after every 3 to 10 suction operations, or depending on the degree of contamination detected or measured.

During the cleaning, the suction tool 520 is likewise brought into the position which is shown in FIG. 2 and in which the positioning and displacement of suctioned fibers in the edge region of cavities 522 takes place. In contrast to the positioning of fibers, no fibers are previously suctioned in during the cleaning. Thus, the cavities 522 are free except for the impurities.

In further embodiments, after this a traversing of the underside of the suction tool 520 takes place in substantially the same manner, with the difference that the nozzles 940 are directed directly onto the cavities 522. This means that nozzles 940 which are not or cannot be directed onto the cavities 522 are not acted upon by or sealed with medium. Furthermore, during the cleaning, the nozzles 940 can be changed in their orientation so that an exiting jet of medium, e.g., water, impinges on the surface of the cavities 522 at a different angle. In addition, the type of jet can be changed so that a better detachment of adhering fibers can be achieved. Furthermore, the pressure of the jet can also be changed in order to increase the cleaning effect.

Furthermore, in still further embodiments, the bar 930 with the nozzles 940 can be inclined as shown in FIG. 2 in order for example to change the orientation of all the nozzles 940 during cleaning.

Furthermore, individual nozzles 940, groups of nozzles 940 or all nozzles 940 can also be inclined during the cleaning while traveling parallel to the underside of the suction tool 520, or can be changed with regard to orientation, jet type, pressure and/or opening width, so that there is an optimal cleaning for the cavities 522 at each point of the surface of the cavities 522 by means of a corresponding controlling of the nozzles 940, and a medium jet which is optimally designed for the cleaning. Here, a continuous adjustment of the nozzles 940 or outlet openings 942 can generally take place during the cleaning along the travel path of the bar 930. For this purpose, during a movement of a bar 930 along the underside of a suction tool 520, individual nozzles 940, groups of nozzles 940, or all nozzles 940 can also be closed and opened. In particular, this can be controlled separately for each nozzle 940 or group of nozzles 940.

Figure 3:
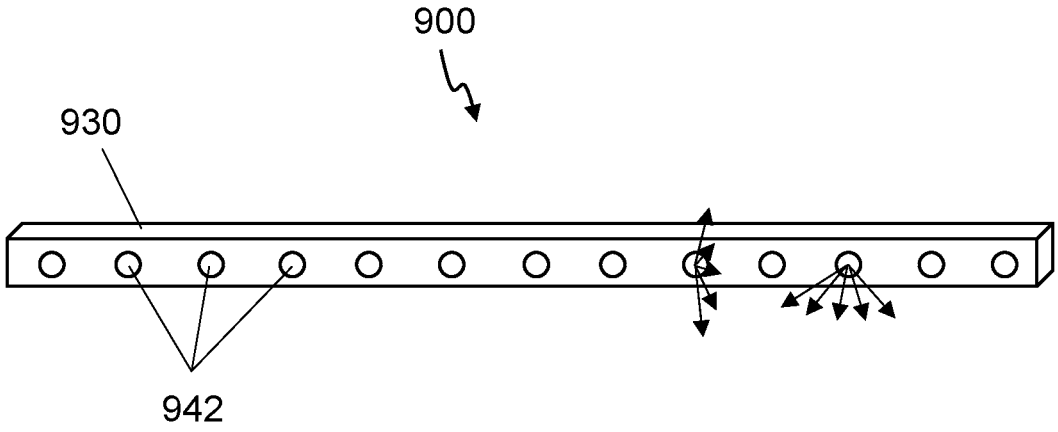
FIG. 3 shows a schematic representation of a bar of an alignment unit.

FIG. 3 shows a schematic representation of a bar 930 of an alignment unit 900 with a plurality of outlet openings 942. Outlet openings 942 generally denote the devices/elements for dispensing a medium for the positioning of fibers and cleaning of cavities 522. In the exemplary embodiments shown, the outlet openings 942 are designed as nozzles 940. However, other embodiments of outlet openings 942 may be used, which may be controlled in orientation, opening width, cross-sectional shape, etc., to represent at least two different modes of operation, namely cleaning mode and positioning mode of fibers for edge formation. In FIG. 3, different jet types and output directions are indicated schematically by the arrows.

Figure 4:
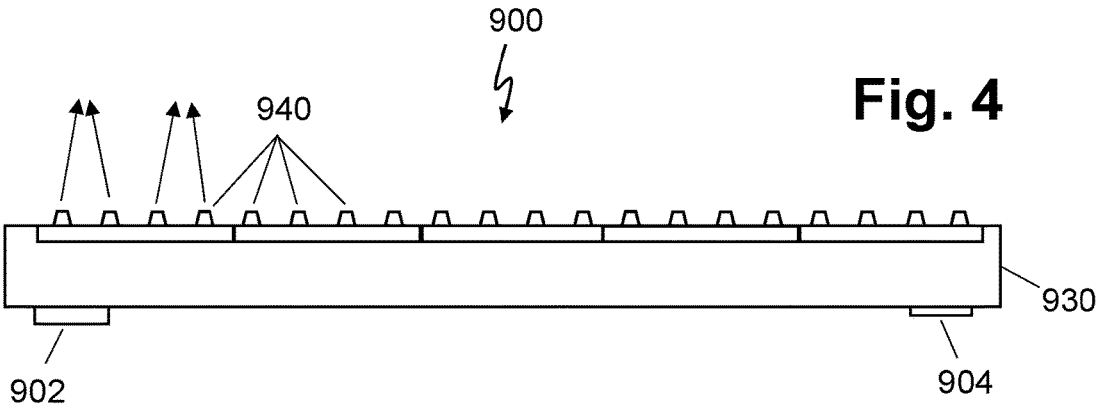
FIGS. 4-6 show schematic representations of further embodiments of components of an alignment unit.
Figure 5:
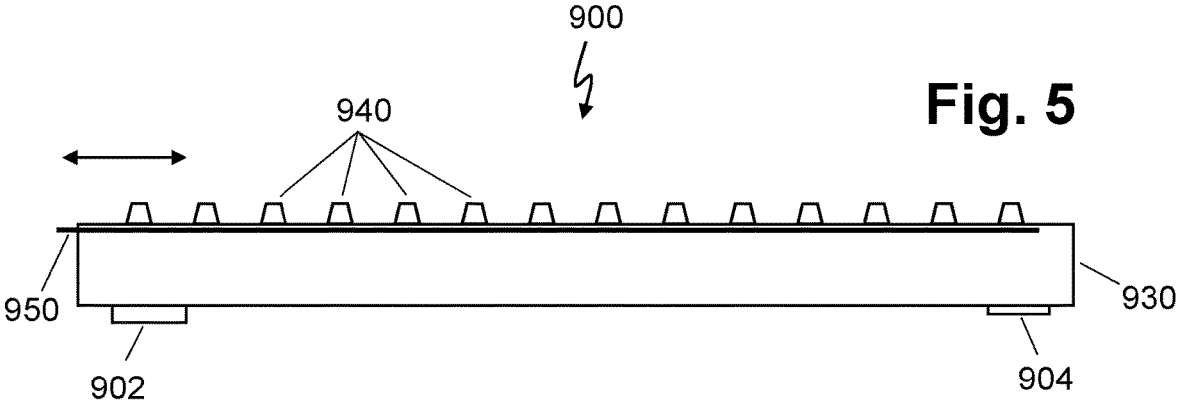
Figure 6:
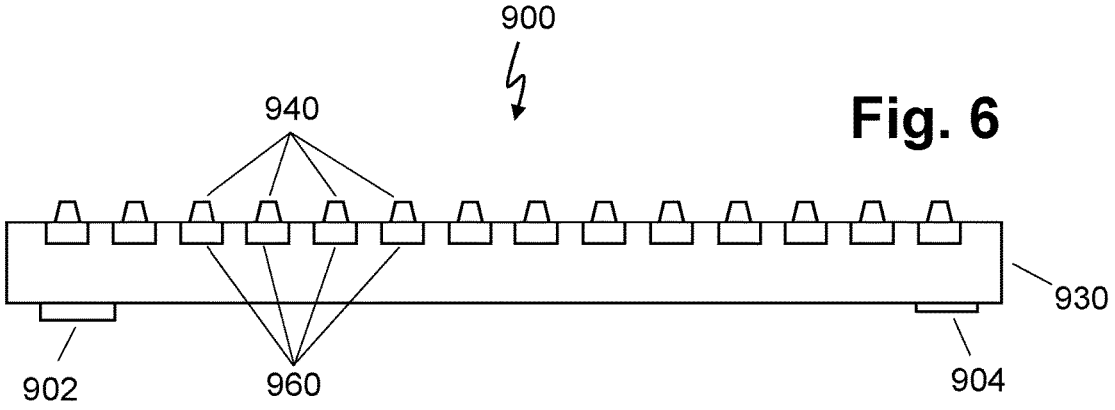

FIGS. 4-6 show schematic representations of further embodiments of components of an alignment unit 900. The alignment units 900 can each have an identification feature 904 and/or an interface 902, as schematically shown in FIGS. 4-7. The supply of medium can take place via an interface 902. In addition, control signals and/or bidirectional communication with a control unit, for example a fiber processing device 1000, can take place via this. In addition, the energy supply of, for example, electronic/electrical components, such as servomotors 960, can take place via this. In addition, in further embodiments it is possible for mechanical communication between a control device and the alignment unit 900 to take place via an interface 902. For example, a pin may press against a movable element of the alignment unit 900, which then causes a displacement, for example of an orifice plate 950 (see FIG. 5).

An identification feature 904 can have a coding, for example. The coding contains information about, or is representative of the information about, the type of alignment unit 900. Thus, via a coding, for example an assignment to a corresponding suction tool 520, which has a corresponding identification feature 524, can be produced. Identification features 904, 524 can have or be for example a bar code, an RFID transponder, a mechanical interface (key-lock principle) and/or another device ensuring an unambiguous identification of the alignment unit 900 or the suction tool 520. For example, the supply of medium can be regulated depending on the identification feature 904.

Furthermore, a controller can control the operation of a fiber processing device 1000 in accordance with the built-in suction tool 520 and the installed alignment unit 900. It can be recognized on the basis of the identification feature 524 how many or which type of cavities 522 are provided on the suction tool 520. The alignment unit 900 is activated according to the automatically detected suction tool 520. Via the identification feature 904, the specifications and possible operating modes of the drive unit 900 are available as information to an associated controller (for example controller 310) so that the controlling can take place within the scope of the control possibilities. In further embodiments, an operation of the fiber processing device 1000 can be started only when the suction tool 520 and the alignment unit 900 have corresponding identifying features 524, 904, thereby enabling a fiber positioning and cleaning of cavities 522 via an alignment unit 900 for a specific type or realization of suction tool 520. If there is no agreement about the identifying features 524, 904, operation of a fiber processing device 1000 cannot be started and an error message is output via an HMI panel 700, for example.

The interface 902 and/or the identification feature 904 can, as shown in FIG. 4-7, be arranged for example on a bar 930. In further embodiments, interfaces 902 and/or identification features 904 can also be arranged other locations of an alignment unit.

In the embodiment of FIG. 4, nozzles 940 are combined in groups and can be controlled together in groups in order to regulate the output quantity, the output direction and the medium jet type in groups.

In the embodiment of FIG. 5, an orifice plate 950 is provided that is displaceable along the configuration of nozzles 940. The displacement of the orifice plate 950 can take place for example manually or via a drive (electrically, pneumatically, hydraulically, mechanically). The orifice plate 950 has a number of openings corresponding to the number of nozzles 940. The openings and nozzles 940 are located opposite each other such that the quantity and orientation of supplied medium can be changed by moving the orifice plate 950. In further embodiments, an orifice plate can include at least two openings per nozzle 940, wherein the at least two openings can differ at least with respect to the diameter and/or cross-section of the openings. In these or further embodiments, the orifice plate 950 can also be brought into a position in which the supply of medium to the nozzles 940 is prevented at least for a part of the nozzles 940, for which purpose the corresponding nozzles 940 are situated opposite a section without opening the orifice plate 950.

In the embodiment of FIG. 6, each nozzle 940 is assigned a servomotor 960 which makes it possible to individually control each individual nozzle 940 with regard to output quantity, output direction, jet type, etc. In further embodiments, instead of servomotors 960, other actuating units can also be provided which are controllable independently of one another and enable individual regulation of the dispensed medium.

Figure 7:
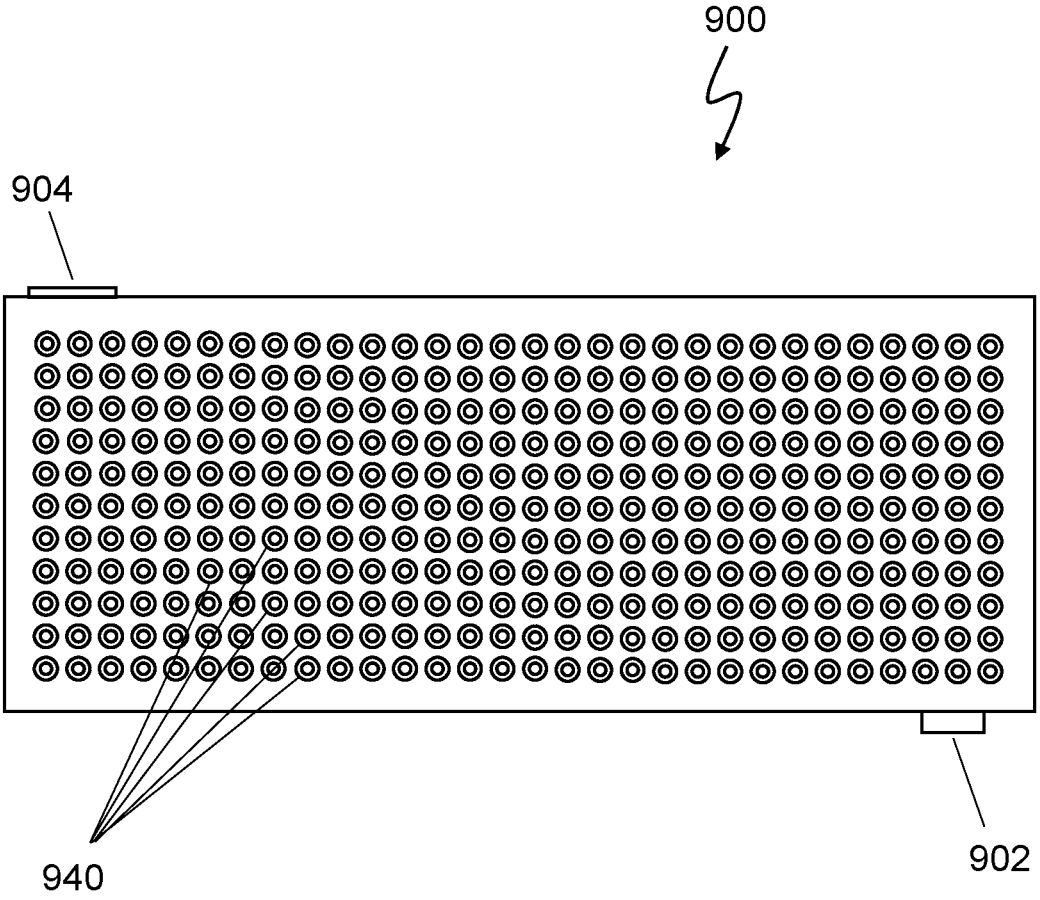
FIG. 7 shows a schematic representation of a further embodiment of an alignment unit.

FIG. 7 is a schematic view of a further embodiment of an alignment unit 900 which is designed such that it is situated opposite a large part of the underside of a suction tool 520, or corresponds to the underside in terms of surface area.

Instead of a bar 930, the alignment unit 900 has a plate-shaped unit on which several rows and columns of nozzles 940 are arranged. Depending on the embodiment, the nozzles 940 can be individually controlled individually, in groups or together. In further embodiments, the surface extension of the plate-shaped unit with the nozzles 940 corresponds to the surface extension of the underside of a suction tool 520 with the cavities 522. In such an embodiment, it is not necessary to move the unit with the nozzles 940 parallel to the underside with the cavities 522. Rather, a parallel arrangement of the underside of the suction tool 520 and of the plate with the nozzles 940 can take place both for the fiber positioning and for the cleaning. Subsequently, the corresponding cleaning or fiber positioning is carried out via the medium, wherein in each case only the required nozzles 940 are operated and are adapted with regard to their output quantity, direction and jet type. It is also possible, for example, to output a rotating jet via the nozzles 940 during the cleaning, significantly supporting a cleaning.

Furthermore, the embodiment of FIG. 7 offers the possibility of the best possible cleaning of a plurality of different suction tools 520 and positioning the fibers in the edge region of cavities 522.

Figure 8:
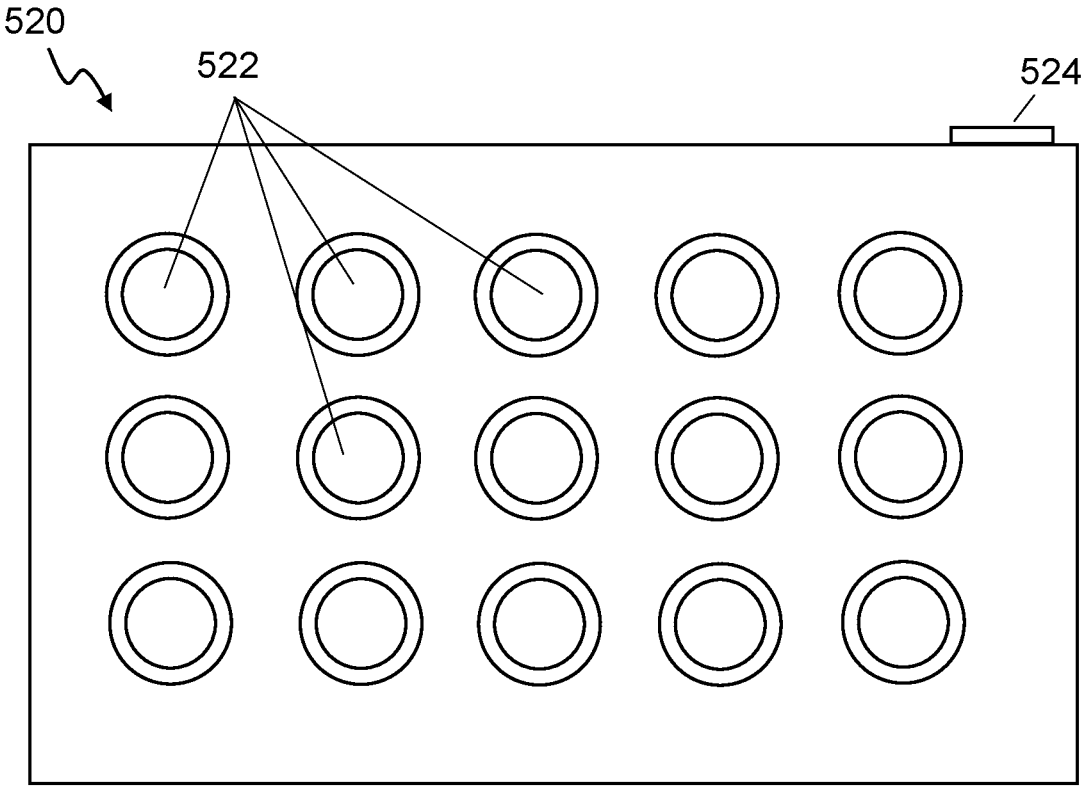
FIGS. 8, 9 show schematic representations of suction tools.
Figure 9:
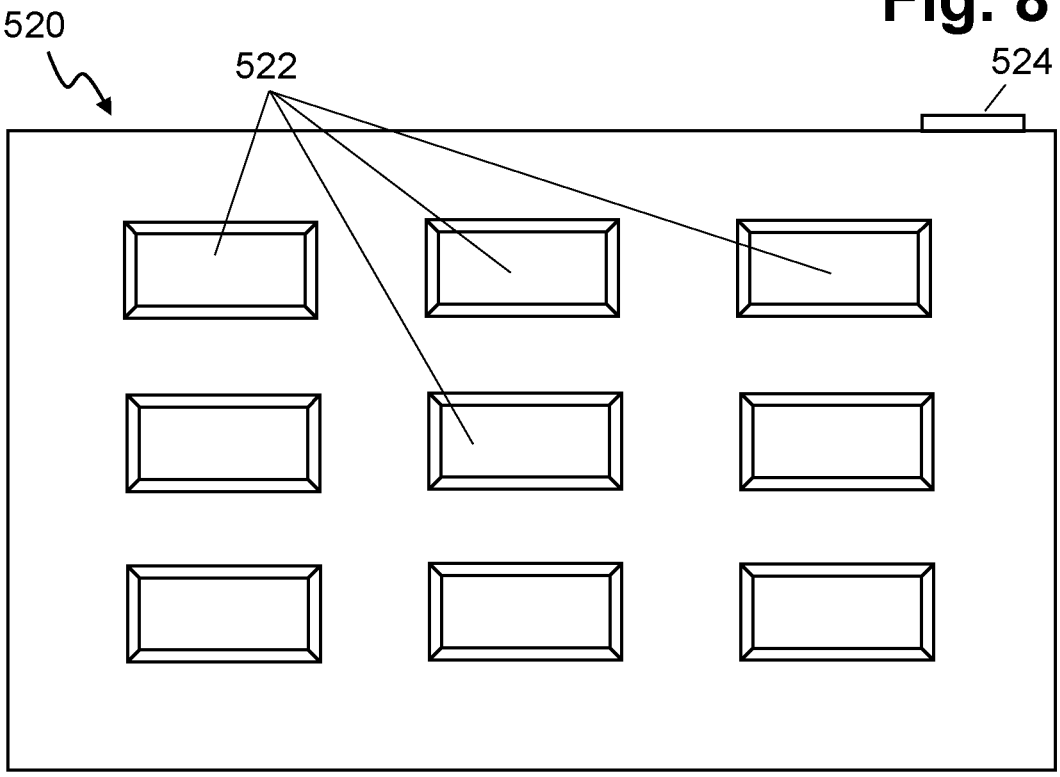

FIGS. 8, 9 show schematic representations of different suction tools 520. FIGS. 8 and 9 each show the underside with the cavities 522 for suctioning fibers from a pulp of different suction tools 520. The two examples show how different the shapes and the number of cavities 522 can be in different suction tools 520 for different molded parts. Accordingly, the surfaces between the cavities 522 are also formed differently so that a different orientation of outlet openings 942 or nozzles 940 is required for displacement and positioning of the fibers, in particular in the edge region of the cavities 522, as well as for cleaning the cavities 522. The edge region is the region that defines the edge of a molded part and, for example, adjoins or passes from the cavities 522 to the surface of the underside of the suction tool 520 (see also FIG. 2).

In particular, when an alignment unit 900 is formed with a bar 930 that traverses or is displaced parallel to the underside of a suction tool 520, it is apparent from the two embodiments that permanent adaptation of the outlet openings 942 or nozzles 940 may be required to achieve both a positioning of fibers in the edge region of the cavities 522 and a cleaning of the cavities 522. For this purpose, the alignment openings 942 or the nozzles 940 can be changed continuously in their orientation and the nozzles can be activated and deactivated at least in sections during the movement of the bar 930 along the travel path, i.e., temporarily no medium exits via the outlet openings 942/nozzles 940. In addition, during the displacement of the bar 930, an adaptation of the jet type (e.g., fan-shaped, rectilinear, etc.), the pressure to the dispensed medium, and the medium quantity can take place continuously.

Figure 10:
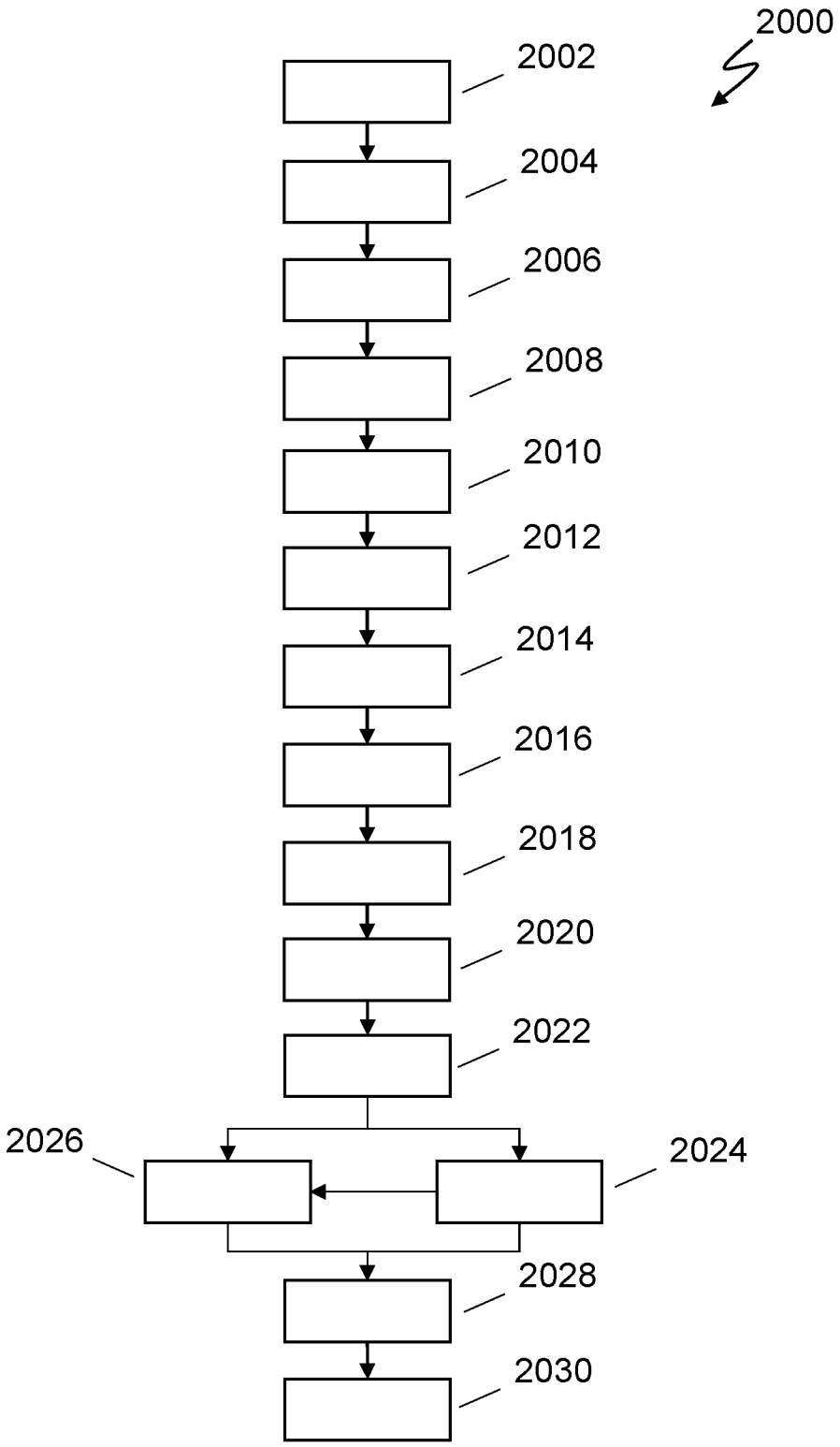
FIG. 10 shows a method for operating a fiber processing apparatus.

FIG. 10 shows a method 2000 for operating a fiber processing device 1000 for producing three-dimensional molded parts from a fiber material using the above-described components and a fiber processing device 1000. In further embodiments, individual steps in the method 2000 may be omitted or performed in a different sequence, provided that achievement of the aims and advantages described herein is still assured.

In a first method step 2002, a suction tool 520 and an alignment unit 900 formed thereon are provided for a fiber processing device 1000, such as the fiber processing device 1000 of FIG. 1. For this purpose, for example, an installation of a suction tool 520 can be carried out. Furthermore, an alignment unit 900 specifically provided for this suction tool 520 can be installed. In further embodiments, it is also possible to carry out only a replacement of a bar 930 with an arrangement of nozzles 940 designed for the installed suction tool 520. In further embodiments, adaptation of the alignment unit 900 for the particular suction tool 520 takes place only by changing the orientation and setting of the nozzles 940.

In a method step 2004, pulp having a fiber content of 0.5 to 10 wt % in an aqueous solution is provided via a pulp tank 200 of the fiber processing equipment 1000 or a separate fiber preparation plant. The pulp is either already in the pulp tank 200 or is fed to the fiber processing device 1000 through appropriate interfaces and lines to the pulp tank 200. For this purpose, the control unit 310 can regulate the supply of pulp from a remote fiber preparation plant according to the filling level of the pulp tank 200. In addition, the composition of the pulp can be monitored continuously or in definable time intervals by means of a corresponding sensor system in order to define the cleaning intervals for the suction tool 520 and in particular the cavities 522.

In a method step 2006, an immersion of the suction tool 520 into the pulp is carried out in accordance with the molded parts to be manufactured, wherein the suction tool 520 is immersed in the pulp so far that the regions of the cavities 522 are in the pulp which are provided for the formation of molded parts.

In a method step 2008, fiber material is then suctioned out of the pulp via the suction device 320, which is controlled accordingly by the control unit 310. In addition, valves in at least one supply line between the suction device 320 and the cavities 522 of the suction tool 520 can be controlled via the control unit 310.

In further production methods, multiple immersion is carried out for providing preforms, wherein the cavities 522 are not completely immersed every time. A positioning of fibers in the edge region of the cavities can be carried out in such embodiments after each immersion process or after completion of the multiple immersion processes.

There then takes place a removal of the suction tool 520 in process step 2010. In method step 2012, the alignment unit 900 is positioned such that it and in particular the bar 930 or an arrangement of nozzles 940 assume an upper position, as described above in particular with reference to FIG. 2. Subsequently, in method step 2014, the suction tool 520 is positioned such that the underside of the suction tool 520 with the cavities 522 is aligned with the alignment unit 900, as described above so that the nozzles 940 are directed toward the underside of the suction tool 520.

In a method step 2016, medium, for example water, is then dispensed through the nozzles 940. For this purpose, in various supplying methods, a valve in a feed line can be controlled via the control unit 310 or the nozzles 940 in order to regulate the output of water. The water is pumped to the nozzles 940 via a pump of the supply units 300, and is dispensed in different orientations and settings according to the mode of operation (fiber positioning/cleaning of the cavities 522) for the alignment unit 900. In method step 2016, after fibers are suctioned, an alignment of the fibers takes place in the edge region of the cavities 522 so that a smooth edge formation is achieved in the cavities 522. For this purpose, a suitably designed bar 930 with nozzles 940 is arranged, the nozzles being aligned accordingly, or the nozzles 940 are adjusted in their alignment in such a way that the particular required positioning of fibers is achieved.

Subsequently, in a method step 2018, the bar 930 is moved downward parallel to the underside of the suction tool 520 so that a positioning of the fibers is achieved at all edges of the cavities 522. Here, the nozzles 940 are continuously aligned with the movement of the bar 930 according to the formation of the cavities 522.

In further embodiments, the nozzles 940 on a bar 930 or plate having a plurality of rows of nozzles 940 can each occupy only two positions. One of the positions is provided for the positioning of the fibers and the other position of the nozzles 940 is provided for the cleaning of the cavities 522. Depending on the operating mode for the alignment unit 900, a corresponding controlling and alignment of the nozzles 940 then takes place.

Referring to the previous example with multiple nozzles 940, after the fiber positioning there takes place a movement of the suction tool 520 to the pre-pressing station 400 and a pre-pressing of the fiber material in the cavities 522 and the pre-pressing molds. After pre-pressing, the suction tool 520 with the pre-pressed preforms in the cavities 522 can be moved to a hot pressing station 600 with the hot pressing device 610, wherein a pressing of the pre-pressed preforms under high pressure and high temperatures into finished three-dimensional molded parts made of a fiber-containing material takes place. After the hot pressing, the molded parts produced can be removed or supplied to further processing. These processing steps are combined in method step 2020.

Thereafter, the alignment unit 900 is returned to its original position and the suction tool 520 is again immersed in the pulp tank 200 for sucking fibers. The process described above can be repeated as often as required to produce three-dimensional molded parts. At regular intervals, the cavities 522 are cleaned, for which purpose no fibers are suctioned in and the suction tool 520, instead of being immersed in the pulp tank 200, moves directly into position with respect to the alignment unit 900, so that fibers adhering over the nozzles 940 are removed by the output water. For this purpose, it is usually necessary to control the nozzles 940 differently so that the water only moves into/to the cavities 522, but impinges on and thus cleans the entire surface of the cavities 522. All other nozzles 940 can be deactivated for this purpose in the cleaning mode so that no water escapes via these nozzles 940. In addition, the active nozzles 940 are controlled differently than in the fiber deposition mode, wherein, for example, a higher water pressure is provided and the jet type and the orientation of the exiting jet are changed. For this purpose, in further embodiments, a bar 930 can be tilted at the same time in order to change the angle of incidence of the water.

In further embodiments, the nozzles 940 can be adapted continuously during the parallel displacement of the bar 930 to the underside of the suction tool 520 with the cavities 522. In other embodiments, only two different positions and orientations for the nozzles 940 are provided, which are selected and set depending on the operating mode. Here, in both operating modes the set orientations of the nozzles 940 can be maintained during the entirety of the displacements parallel to the underside of the suction tool 520.

In a method step 2022, the suction tool 520 is changed to produce other three-dimensional molded parts. So that, for the new type of molded parts, an optimal fiber positioning and cleaning are possible for their cavities 522, either the alignment unit 900 or a component of it, for example the bar 930, is replaced with a specific nozzle arrangement, wherein a nozzle arrangement is installed with a nozzle orientation and orientation adapted for the new formation and arrangement of cavities 522, and/or a change in the orientation of the nozzles 940 is carried out.

In method step 2024, an exchange takes place of at least one component of the alignment unit 900, or the alignment unit 900 is exchanged. Here, an assignment and selection can take place according to the identification features 524, 904, as described above.

In the alternative method step 2026, which can also be carried out in addition to the exchange in method step 2024, the nozzles 940 are adapted in accordance with the suction tool 520 used, wherein in particular here the control unit 310 can make use of the information provided via the identification features 524, 904.

Further, here at least one adaptation of the orientation and parameters of the nozzles 940 can be made according to the operating mode (cleaning/fiber positioning). Furthermore, in further embodiments, a continuous adaptation and changing of the nozzles 940 can take place for a continuous changing and adaptation of the dispensed water jet to the shape and structure of the cavities 522 and the operating mode.

In method step 2028, an adapted alignment of the nozzles 940 then takes place in accordance with the cavities 522 used and, in method step 2030, a further processing analogous to the further processing described above after the fiber positioning.

Furthermore, an adapted cleaning is also carried out at regular intervals for the new suction tool 520, as explained above. The method 2000 can run as often as desired and an adaptation according to method step 2024 and/or 2026 takes place upon each change of suction tools 520.

Cleaning intervals are, for example, 3 to 10 suction cycles, i.e., a cleaning must be carried out after 3 to 10 suction processes. The cleaning intervals depend on the dimension and geometry the cavities 522 have, the composition of the pulp and, in particular, the fiber length of the fibers in the pulp, as well as the pressure at which the fibers are suctioned and whether multiple immersion in the pulp takes place or preforms are formed by only single immersion.

The process described above and the method can be run through continuously, wherein during the continuous production of molded parts made of fiber material, production takes place in such a way that processing can preferably take place simultaneously in each station. Furthermore, according to the teaching described herein, it is also possible to carry out only an adaptation and cleaning, in particular during a tool change, so that the additional method steps indicated above which relate to the processing are not absolutely necessary.

Figure 11:
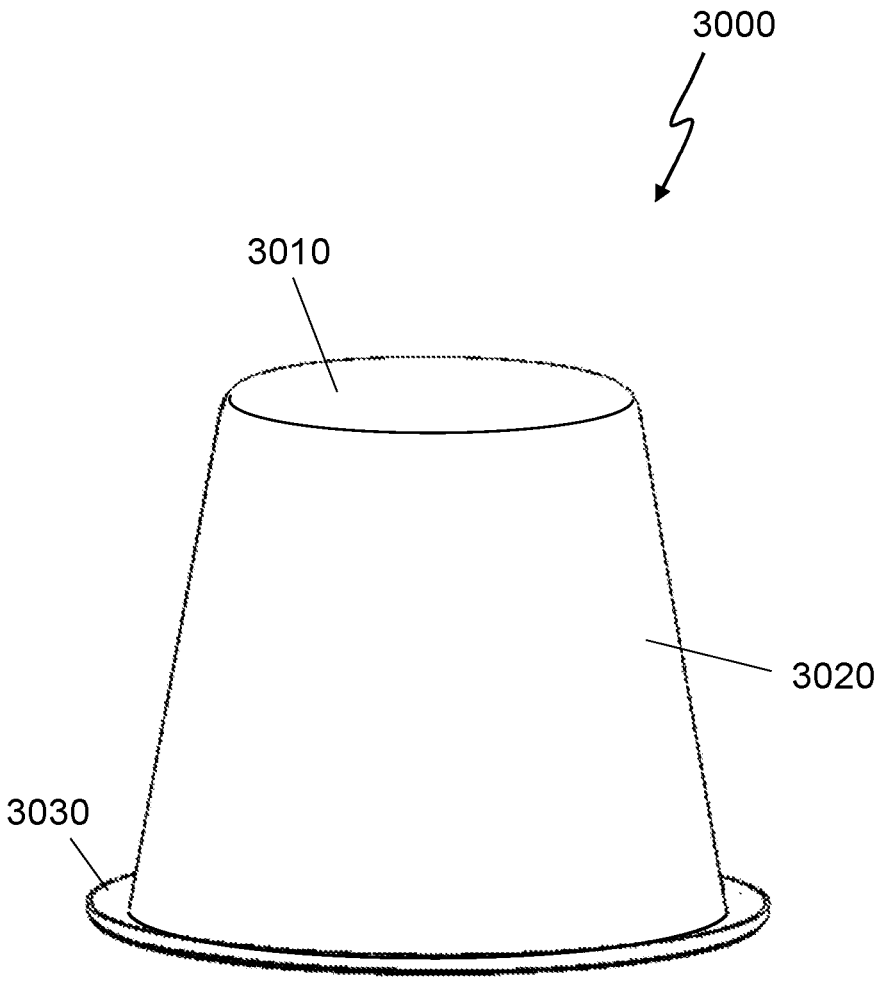
FIG. 11 shows a schematic representation of a three-dimensional molded part made of a fiber-containing material.

FIG. 11 is a schematic view of a three-dimensional molded part made of a fiber-containing material, which is designed as a cup 3000 in the embodiment shown and is produced according to one of the above methods 2000. The cup 3000 can be produced, for example, with a fiber processing device 1000 according to FIG. 1. Such a cup 3000 has, after the hot pressing, for example a residual moisture content of, for example, 1 to 7% by weight.

The cup 3000 has a bottom 3010 and a circumferential side wall 3020 extending from the bottom 3010, which runs relatively steeply from the bottom 3010. At the upper end of the side wall 3020, a circumferential edge 3030 extends that runs substantially parallel to the bottom 3010. In the exemplary embodiment shown, the wall thickness of the cup 3000 is the same everywhere in the bottom 3010, in the side wall 3020 and in the edge 3030.

Through the positioning of the fibers before the pre-pressing, a very fine formation of the edge 3030 is achieved without additional processing steps being required. Furthermore, the flexible configuration of the alignment unit 900 in the case of differently designed molded parts ensures that a high edge quality can be ensured for a large number of molded parts. Until now, a compromise had to be accepted for a spraying device with respect to cleaning and edge formation and to different molded parts, because no adaptation was possible. In contrast, the solution described herein offers an adaptation with regard to the above points, so that both an optimal edge formation and an optimal cleaning of the cavities in question can take place for a large number of molded parts.

LIST OF REFERENCE NUMBERS

100 frame
200 pulp tank
300 supply units
310 control unit
320 suction device
400 pre-pressing station
500 robot
510 robot arm
512 robot interface
520 suction tool
522 cavity
524 identifying feature
600 hot pressing station
610 hot pressing device
700 HMI panel
800 conveying device
810 camera
900 alignment unit
902 interface
904 identifying feature
910 bearing
920 arm
930 rail
940 nozzle
942 outlet opening
950 orifice plate
960 servomotor
1000 fiber processing device
2000 method
2002-2032 method steps
3000 cup
3010 bottom
3020 side wall
3030 edge

What is claimed is:

1. A fiber processing device for producing three-dimensional molded parts from a fiber-containing material, at least having a forming station with an exchangeable tool on which fiber-containing material is configured to be deposited, wherein different exchangeable tools for producing different three-dimensional molded parts are receivable in the at least one forming station, and at least one alignment unit assigned to at least one of the exchangeable tools for displacing and positioning fibers deposited on a surface of said exchangeable tool by a prior process, wherein the at least one alignment unit has a plurality of outlet openings for a medium, wherein the at least one alignment unit is supplied with the medium that is dispensed via the outlet openings for the displacement and positioning of the fibers already deposited on the surface of said exchangeable tool to form defined edges in preforms of the molded parts formed from the fibers, wherein the outlet openings of the at least one alignment unit are adaptable in accordance with said exchangeable tool received in the at least one forming station.

2. The fiber processing device according to claim 1, wherein at least one parameter of at least one outlet opening of the at least one alignment unit is changeable in order to change a quantity, direction, type, and/or orientation of the medium.

3. The fiber processing device according to claim 2, wherein the at least one parameter defines a diameter, shape, orientation, and/or size of the at least one outlet opening.

4. The fiber processing device according to claim 1, wherein the at least one alignment unit is exchangeable.

5. The fiber processing device according to claim 1, wherein the outlet openings are adaptable in accordance with said exchangeable tool received in the forming station.

6. The fiber processing device according to claim 5, wherein the adaptation of the outlet openings takes place and/or can take place automatically during an exchangeable tool change.

7. The fiber processing device according to claim 1, wherein said exchangeable tool and the alignment unit for this exchangeable tool have a feature that identifies said exchangeable tool and the alignment unit.

8. The fiber processing device according to claim 1, wherein the outlet openings can be changed pneumatically, hydraulically, electrically, mechanically, and/or electromechanically.

9. The fiber processing device according to claim 1, wherein the outlet openings are always aligned and/or adaptable in accordance with the position of mold bodies and/or cavities of said exchangeable tool received in the forming station and/or a geometry of the mold bodies and/or cavities of said exchangeable tool received in the forming station.

10. The fiber processing device according to claim 1, wherein the outlet openings of the alignment unit are individually controllable, wherein the outlet openings of the alignment unit are controllable independently of other outlet openings with respect to direction, quantity, and duration of discharged medium.

11. The fiber processing device according to claim 1, wherein the outlet openings of the alignment unit are combined into groups which are controllable together, wherein the groups of outlet openings of the alignment unit are controllable independently of other groups of outlet openings of the alignment unit with respect to direction, quantity, and duration of discharged medium.

12. The fiber processing device according to claim 1, wherein the outlet openings are formed as nozzles.

13. A method for operating a fiber processing device for producing three-dimensional molded parts from a fiber-containing material, at least having a forming station with an exchangeable tool and an alignment unit, the exchangeable tool being subject to processing for deposition of fibers on a surface of the exchangeable tool before use of the alignment tool, the alignment unit having a plurality of outlet openings for directing a medium towards the surface of the exchangeable tool, wherein dispensing the medium via the outlet openings in determinable time periods displaces and positions the fibers already deposited on the surface of the exchangeable tool to form defined edges in preforms of the molded parts formed from the fibers, wherein different exchangeable tools are received in the forming station in order to produce different three-dimensional molded parts, wherein one exchangeable tool received in the forming station is exchanged for another exchangeable tool, and wherein, when there is an exchangeable tool change of the received exchangeable tool in the forming station for the another exchangeable tool, the outlet openings of at least one alignment unit are changed in accordance with the received exchangeable tool and its configuration.

14. The method according to claim 13, wherein at least one parameter of at least one outlet opening is changed to change a quantity, direction, type, and/or orientation of the medium, and wherein the at least one parameter defines a diameter, shape, orientation, and/or size of the at least one outlet opening.

15. The method according to claim 13, wherein the alignment unit is exchanged for another alignment unit when one exchangeable tool is exchanged in the forming station for another exchangeable tool, wherein the alignment unit is assigned to the exchangeable tool.

16. The method according to claim 13, wherein the outlet openings are automatically adapted and/or changed when there is the exchangeable tool change.

17. The method according to claim 13, wherein the outlet openings are changed pneumatically, hydraulically, electrically, mechanically, and/or electromechanically.

18. The method according to claim 13, wherein the outlet openings are aligned and/or adapted according to the position of mold bodies and/or cavities of the exchangeable tool received in the forming station and/or a geometry of the mold bodies and/or cavities of the exchangeable tool received in the forming station.

19. The method according to claim 13, wherein the outlet openings are closed to prevent the dispensing of the medium.

20. The method according to claim 13, wherein the outlet openings of the alignment unit or groups of outlet openings of the alignment unit are controlled independently of other outlet openings or groups of outlet openings of the alignment unit with respect to direction, quantity and duration of discharged medium.

* * * * *